US011008759B2

(12) United States Patent
Jenkins et al.

(10) Patent No.: US 11,008,759 B2
(45) Date of Patent: May 18, 2021

(54) ROOFING PRODUCT INCLUDING A HEATER

(71) Applicant: CertainTeed Corporation, Malvern, PA (US)

(72) Inventors: Robert L. Jenkins, Honey Brook, PA (US); Stephen A. Koch, Collegeville, PA (US); Gregory F. Jacobs, Oreland, PA (US)

(73) Assignee: CERTAINTEED CORPORATION, Malvern, PA (US)

( * ) Notice: Subject to any disclaimer, the term of this patent is extended or adjusted under 35 U.S.C. 154(b) by 154 days.

(21) Appl. No.: 14/203,139

(22) Filed: Mar. 10, 2014

(65) Prior Publication Data

US 2014/0263267 A1 Sep. 18, 2014

Related U.S. Application Data

(60) Provisional application No. 61/780,240, filed on Mar. 13, 2013.

(51) Int. Cl.
*E04D 13/10* (2006.01)
*H05B 3/26* (2006.01)
(Continued)

(52) U.S. Cl.
CPC ..... *E04D 13/103* (2013.01); *H05B 3/12* (2013.01); *H05B 3/145* (2013.01); *H05B 3/146* (2013.01);
(Continued)

(58) Field of Classification Search
CPC ..... E04D 1/26; E04D 13/103; H05B 3/20; H05B 3/26; H05B 2203/003
(Continued)

(56) References Cited

U.S. PATENT DOCUMENTS 2,106,067 A 1/1938 Schmidt
2,546,743 A 3/1951 Harrison
(Continued)

FOREIGN PATENT DOCUMENTS

WO 2012139018 A2 10/2012

OTHER PUBLICATIONS

Heated Roof Systems Ice & Snow Melting System Roof Hearing & Deicing "Radiant Roof Melting System", 4 pgs, Nov. 13, 2012.
(Continued)

*Primary Examiner* — Erin E McGrath
(74) *Attorney, Agent, or Firm* — Abel Schillinger, LLP; Thomas H. Osbron

(57) ABSTRACT

A roofing product can include a heater. In an embodiment, the heater can have different areas that have different heat flux capacities, different portions having heater elements of different lengths or a combination thereof. The roofing product can be installed so that an area of the roof that has a higher heat load, such as near an eave and a valley of the roof, can receive more heat. In another embodiment, the roofing product includes an overhang section that includes at least a portion of the heater. The roofing product can be installed, and the overhang section can be coupled to an object that extends beyond an edge of the roof or over a plane defined by a roof. Many different manufacturing techniques can be used to form the heaters.

9 Claims, 9 Drawing Sheets

(51) Int. Cl.

| | |
|---|---|
| ***H05B 3/14*** | (2006.01) |
| ***H05B 3/34*** | (2006.01) |
| ***H05B 3/58*** | (2006.01) |
| ***H05B 3/12*** | (2006.01) |
| *H01C 17/065* | (2006.01) |

(52) U.S. Cl.
CPC ..... *H05B 3/262* (2013.01); *H05B 3/265* (2013.01); *H05B 3/267* (2013.01); *H05B 3/34* (2013.01); *H05B 3/347* (2013.01); *H05B 3/58* (2013.01); *H01C 17/065* (2013.01); *H05B 2203/002* (2013.01); *H05B 2203/003* (2013.01); *H05B 2203/005* (2013.01); *H05B 2203/011* (2013.01); *H05B 2203/013* (2013.01); *H05B 2203/017* (2013.01); *H05B 2203/037* (2013.01); *H05B 2214/02* (2013.01); *Y10T 29/49083* (2015.01)

(58) Field of Classification Search
USPC ..... 219/213
See application file for complete search history.

(56) References Cited

U.S. PATENT DOCUMENTS 3,129,316 A 4/1964 Glass
3,521,029 A * 7/1970 Toyooka ..... E04D 13/10 219/201
3,668,367 A * 6/1972 Williams ..... H05B 3/342 219/212
3,691,343 A 9/1972 Norman
3,904,847 A 9/1975 Adams
4,081,657 A 3/1978 Stanford
4,485,297 A 11/1984 Grise et al.
4,633,068 A * 12/1986 Grise ..... H05B 3/26 219/543
4,733,059 A 3/1988 Goss et al.
5,019,797 A 5/1991 Marstiller et al.
5,038,018 A 8/1991 Grise et al.
5,509,246 A 4/1996 Roddy
5,664,385 A 9/1997 Koschitzky
5,813,184 A 9/1998 McKenna
6,166,352 A * 12/2000 Turton ..... E04D 13/103 219/213
6,180,929 B1 * 1/2001 Pearce ..... E01C 11/265 219/213
6,184,495 B1 2/2001 Jones
6,184,496 B1 2/2001 Pearce
6,228,785 B1 * 5/2001 Miller ..... E04D 1/26 442/104
6,348,673 B2 2/2002 Winters
6,489,594 B2 12/2002 Jones
6,727,471 B2 4/2004 Evans et al.
7,121,056 B2 10/2006 McKenna
7,326,881 B2 * 2/2008 Jones ..... F24D 13/02 219/213
8,158,231 B2 4/2012 Hopkins et al.
8,216,407 B2 7/2012 Kalkanoglu et al.
8,946,600 B1 2/2015 Dupuis
9,095,007 B2 7/2015 McGillycuddy
2001/0032834 A1 * 10/2001 Winters ..... E04D 13/0445 219/213
2001/0049002 A1 12/2001 Mccumber et al.
2002/0152697 A1 10/2002 Hokkirigawa et al.
2004/0004066 A1 1/2004 Evans et al.
2004/0244324 A1 * 12/2004 McKenna ..... E04D 13/103 52/533
2005/0198917 A1 9/2005 Hokkirigawa et al.
2005/0199610 A1 * 9/2005 Ptasienski ..... H05B 3/26 219/543
2006/0289000 A1 12/2006 Naylor
2010/0175824 A1 7/2010 Hopkins et al.
2012/0043310 A1 2/2012 Wuchert
2012/0198691 A1 8/2012 Hopkins et al.
2013/0055661 A1 3/2013 McGillycuddy
2013/0319990 A1 12/2013 Casey
2014/0097178 A1 4/2014 Whitcraft
2014/0259996 A1 9/2014 Jenkins et al.
2014/0263266 A1 9/2014 Jenkins et al.
2014/0263267 A1 9/2014 Jenkins et al.

OTHER PUBLICATIONS

Heaterzone.com Roof & Gutter De-Icing Heater Cable "Snow & Ice=Roof & Structure Damage", 5 pgs, Nov. 13, 2012.

* cited by examiner

ROOFING PRODUCT INCLUDING A HEATER

PRIORITY AND RELATED APPLICATION

This applications claims priority under 35 USC § 119(e) from U.S. Provisional Patent Application No. 61/780,240, filed Mar. 13, 2013, entitled "Roofing Product Including A Heater" naming Robert L. Jenkins, Stephen A. Koch, and Gregory F. Jacobs as inventors, which is incorporated herein in its entirety.

This application is related to U.S. Provisional Patent Application No. 61/780,240, filed Mar. 13, 2013; U.S. patent application Ser. No. 14/203,054, filed Mar. 10, 2014; U.S. Provisional Patent Application No. 61/780,094, filed Mar. 13, 2013; and U.S. patent application Ser. No. 14/202,020, filed Mar. 10, 2014; all entitled "Roofing Product Including a Heater" by Jenkins et al. filed of even date, which are assigned to the current assignee hereof and incorporated herein by reference in their entireties.

FIELD OF THE DISCLOSURE

The present disclosure relates to roofing products including heaters and method of forming and installing such roofing products.

RELATED ART

Roofing underlayment can include a heater. The heater may be located along a principal surface of the roofing underlayment and can include a set of substantially identical resistive heater elements. With respect to the area of the roofing underlayment occupied by the heater, the heater may be located only below a nailing portion of the underlayment. If needed or desired, a heater may be trimmed to a particular size within a fabrication or other manufacturing facility, so that the heater is sealed within the roofing underlayment. Further, the underlayment may be installed in conjunction with each course of shingles, such that the underlayment for a particular course of shingles overlaps onto a previously installed course of shingles. Further improvements of roofing products with heaters are desired.

BRIEF DESCRIPTION OF THE DRAWINGS

Embodiments are illustrated by way of example and are not limited in the accompanying figures.

Figure 1:
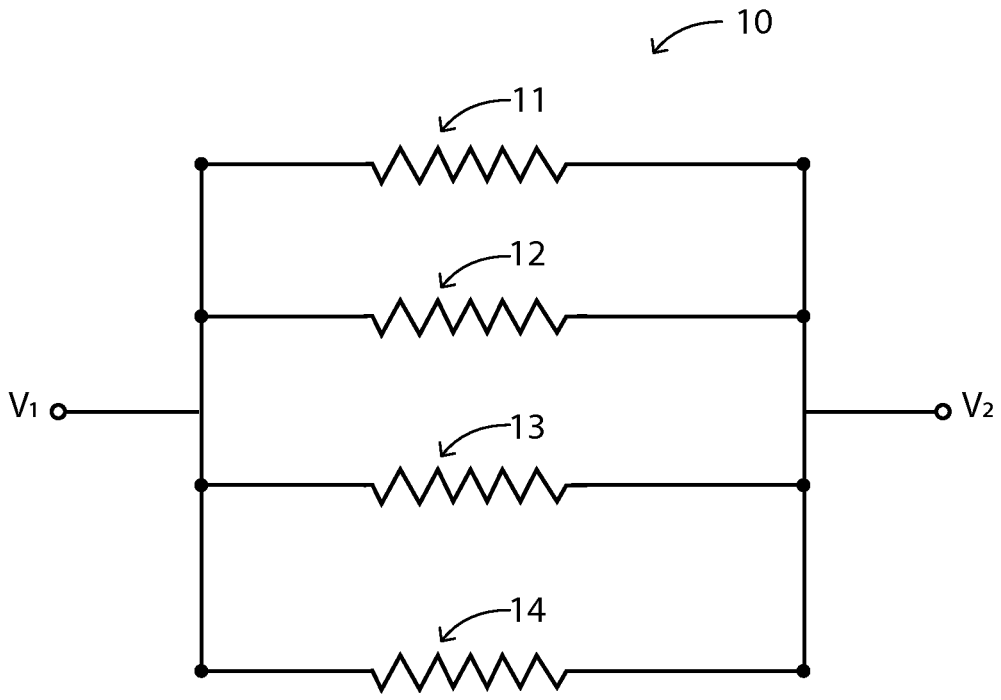
FIG. 1 includes a circuit diagram of a heater having different heater elements with different resistances.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

Before addressing details of embodiments described below, some terms are defined or clarified. The term "heater" is intended to mean a heater element or a plurality of heater elements electrically coupled in parallel to one or more bus bars. Thus, a heater may refer to set of heater elements that are electrically connected along opposite ends by a pair of bus bars or may refer to a particular heater element within the set of heater elements.

The term "principal surfaces," with respect to a roofing product, is intended to mean a pair of opposite surfaces of such roofing product, wherein one of the surfaces lies or would lie farther from a structure to which the roofing product is installed or intended to be installed, and the other surface of such roofing product lies or would lie closer to a structure to which the roofing product is installed or intended to be installed. When installed, the principal surface farther from the structure may be directly exposed to an outdoor environment, and the other principal surface may contact the structure or a different roofing product that lies between the other principal surface and the structure.

As used herein, the terms "comprises," "comprising," "includes," "including," "has," "having" or any other variation thereof, are intended to cover a non-exclusive inclusion.

For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the roofing product arts and corresponding manufacturing arts.

A roofing product can include a heater having different sections or heater elements that have different heat flux capacities. The roofing product can be configured to provide more heat flux, for example, where ice dams are likely to form, where water runoff or collection are relatively greater as compared to other parts of a roof, or the like. Such a design can allow for greater efficiency as more heat can be provided where it is needed or desired, and less heat can be provided where some heat, but less than the greatest amount of heat, is needed or desired.

FIG. 1 includes a schematic circuit diagram of a heater 10 that can be used along a surface of or within a roofing product. The heater 10 includes two terminals $V_1$ and $V_2$ and resistive heater elements 11, 12, 13, and 14 that are connected in parallel. The resistive heater elements 11 to 14 have resistances of $R_{11}$, $R_{12}$, $R_{13}$, and $R_{14}$. In another embodiment, the heater 10 may include more resistive heater elements or fewer resistive heater elements. In particular, the heater 10 can have at least two heater elements or any finite number of heater elements, such as a million or more. In another embodiment, the heater 10 may have no greater than approximately 90,000 heater elements, or more particularly, no more than approximately 9000 heater elements, or even more particularly, no more than approximately 900 heater elements.

The amount of heat generated by each heater element can be proportional to the power consumed by each heater element. The power is the voltage across the heater element times the current, or P=V*I. The voltage can be alternating current voltage or direct current voltage. Exemplary voltages can be voltages commonly provided to residential or commercial customers of electrical utility companies, and can include approximately 120 V, approximately 240 V, or approximately 480 V. In other embodiments, the voltage can be lower or higher than the voltages listed or may be an intermediate value of the voltages listed. Equations for voltage and power include $V=I*R$, $P=I^2*R$. Thus, for the same voltage, power increases exponentially with current and linearly with resistance. Therefore, a lower resistance heater element will have a higher heat flux capacity, which is the maximum amount of heat generated per unit area under normal operating conditions, and may be expressed in units of power per unit area, such as $W/cm^2$.

At least one of the resistive heater elements has a resistance that is significantly different from at least one other heater element. For example, $R_{11}$ can be lower than each of $R_{12}$, $R_{13}$, and $R_{14}$. In a particular embodiment, the resistive heater elements 11 to 14 may be arranged such that $R11 \leq R12 \leq R13 \leq R14$, wherein $R_{11}<R_{14}$. In a more particular embodiment, $R_{11}<R_{12}<R_{13}<R_{14}$, or $R_{11}=R_{12}<R_{13}=R_{14}$, or $R_{11}<R_{12}=R_{13}<R_{14}$. In another embodiment, a resistive heater element near the center may be lower than another heater element. In a particular embodiment $R_{11}>R_{12}$, $R_{13}<R_{14}$, or $R_{11}>R_{12}$ and $R_{13}<R_{14}$. $R_{12}$ may be less than, greater than, substantially equal to, or less than $R_{13}$. After reading this specification, skilled artisans that the arrangement of resistances can be tailored for a particular application.

In a particular application, heat flux capacity can be determined, and then, using the operating voltage, determine the resistance. The resistance can be controlled by selection of materials, dimensions of the heater element, or a combination thereof. Materials can be characterized by resistivities that may be expressed in units of ohm*cm. With respect to the dimensions of the heater element, the length of a heater element can be measured in a direction that is substantially parallel to the current flow, the width and thickness are substantially perpendicular to the current flow, where thickness of the heater element is measured in substantially the same direction as the thickness of the roofing product. The cross-sectional area of the heater element is the width times the thickness. The resistance of a heater element is proportional to the length and inversely proportional to the cross-sectional area. The length and width of the heating may be adjusted to achieve a predetermined resistance, as an increase in length substantially proportionally increases resistance, and an increase in width substantially inversely proportionally decreases resistance. Thickness may be used to control the resistance; however, thickness can affect the profile or overall thickness of the roofing product.

Figure 2:
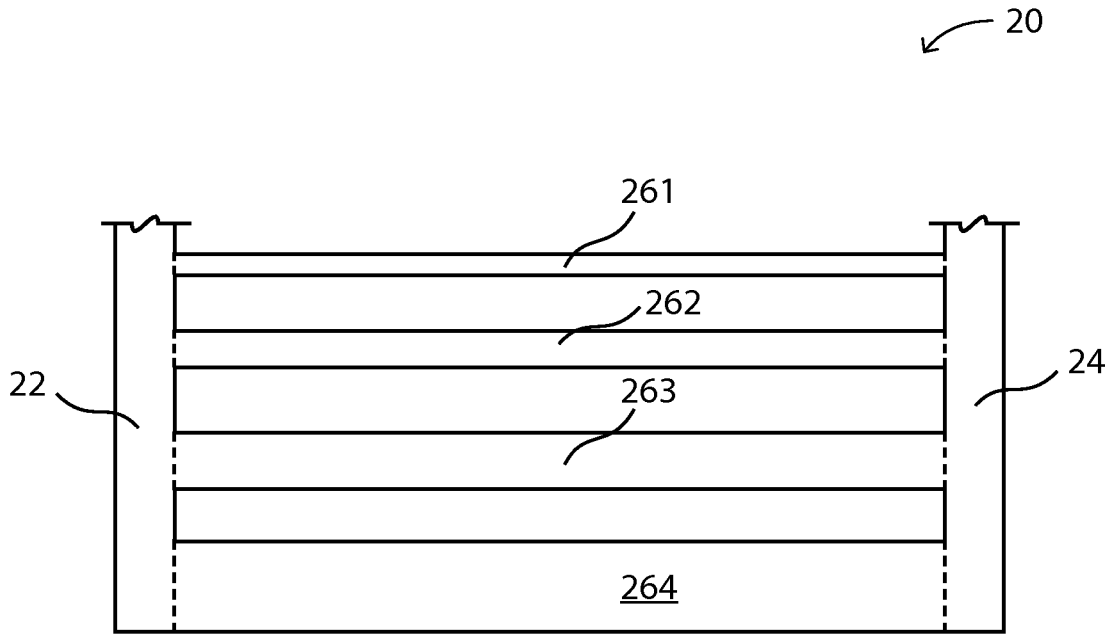
FIG. 2 includes an illustration of a top view of a layout of a heater consistent with the circuit diagram of FIG. 1.

FIG. 2 includes an illustration of a top view of a heater 20 in accordance with an embodiment. The heater 20 includes bus bars 22 and 24 that are coupled to voltage terminals. In a particular embodiment, the bus bars 22 and 24 are electrically connected to the voltage terminals, such as $V_1$ and $V_2$ in FIG. 1. Resistive heater elements 261, 262, 263, and 264 are coupled to the bus bars 22 and 24. The resistances of the bus bars 22 and 24 are substantially lower than the resistive heater elements 261 to 264 to allow most of the heating to occur with the resistive heater elements 261 to 264, as compared to the bus bars 22 and 24. In a particular configuration, the lengths of the resistive heater elements 261 to 264 are substantially the same, the space between each of the resistive heater elements 261 to 264 are substantially equal, or a combination thereof. In FIG. 2, different widths of the resistive heater elements 261 to 264 allow for different heat flux capacities for the different resistive heater elements. In particular, the resistive heater element 261 is the narrowest and has the lowest heat flux capacity, and the resistive heater element 264 is the widest and has the highest heat flux capacity. The resistive heater elements 262 and 263 having intermediate widths and intermediate heat flux capacities. After reading this specification, skilled artisans will be able to determine widths of the resistive heater elements 261 to 264 to achieve a predetermined heat flux capacity.

Figure 3:
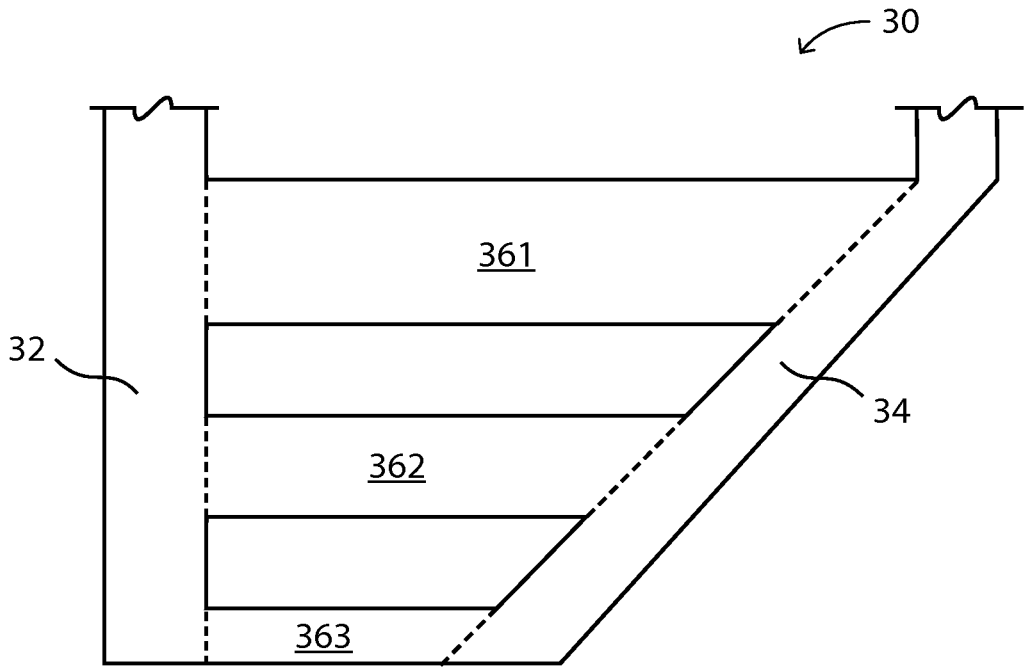
FIG. 3 includes an illustration of a top view of a heater having heater elements with different lengths.

FIG. 3 includes an illustration of a top view of a heater 30 that is configured to provide a relatively uniform heat flux capacity between resistive elements 361, 362, and 363. Bus bars 32 and 34 provide substantially the same functionality as the bus bars 22 and 24 in FIG. 2. Thus, the bus bars 32 and 34 are coupled to voltage terminals. In a particular embodiment, the bus bars 32 and 34 are electrically connected to the voltage terminals. Resistive heater elements 361, 362, and 363 are coupled to the bus bars 32 and 34. In a particular configuration as illustrated in FIG. 3, the length of the resistive element 361 is approximately three times longer than the length of the resistive element 363, and the length of the resistive element 362 is approximately two times longer than the length of the resistive element 363. To obtain a substantially uniform heat flux capacity, the width of the resistive element 361 is approximately three times wider than the width of the resistive element 363, and the width of the resistive element 362 is approximately two times wider than the width of the resistive element 363.

Figure 4:
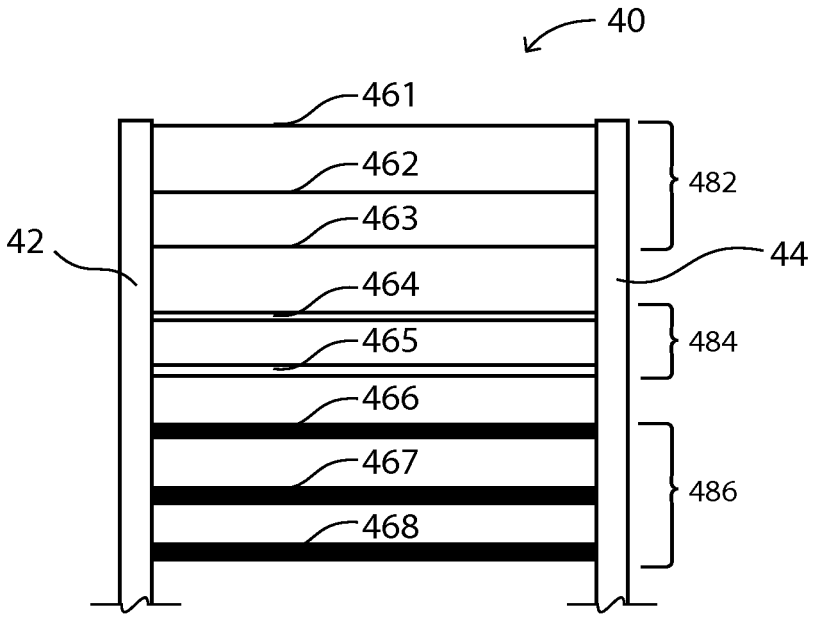
FIG. 4 includes an illustration of a top view of a heater having different heater portions.

FIG. 4 includes an illustration of a top view of a heater 40 that is configured to have different sections, wherein within each section, the resistive elements have substantially the same heat flux capacity. Bus bars 42 and 44 provide substantially the same functionality as the bus bars 22 and 24 in FIG. 2. Thus, the bus bars 42 and 44 are coupled to voltage terminals. In a particular embodiment, the bus bars 42 and 44 are electrically connected to the voltage terminals. Resistive heater elements 461, 462, 463, 464, 465, 466, 467, and 468 are coupled to the bus bars 42 and 44. The heater 40 includes heater sections 482, 484, and 486. The heater section 482 includes the resistive heater elements 461, 462, and 463, the heater section 484 includes the resistive heater elements 464 and 465, and the heater section 486 includes resistive heater elements 466, 467, and 468. The heater section 482 provides less heat flux capacity as compared to each of the heater sections 484 and 486, and the heater section 486 provides more heat flux capacity as compared to each of the heater sections 482 and 484.

Figure 5:
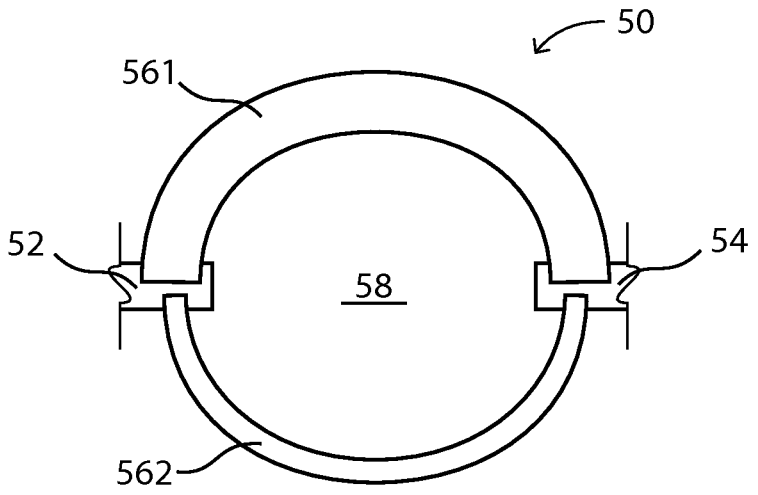
FIG. 5 includes an illustration of a top view of a heater having curved heater elements.

FIG. 5 includes an illustration of a top view of a heater 50 that is configured to have and open area 58 between the heater elements to allow an object to be attached to or extend through the roof. Bus bars 52 and 54 provide substantially the same functionality as the bus bars 22 and 24 in FIG. 2. Thus, the bus bars 52 and 54 are coupled to voltage terminals. In a particular embodiment, the bus bars 52 and 54 are electrically connected to the voltage terminals. Resistive heater elements 561 and 562 are coupled to the bus bars 52 and 54. The resistive heater element 561 has a higher heat flux capacity as compared to each of the resistive heater element 562. When installed, the resistive heater element 561 may be closer to the ridge of the roof, and the resistive heater element 562 may be closer to the eave of the roof.

Figure 6:
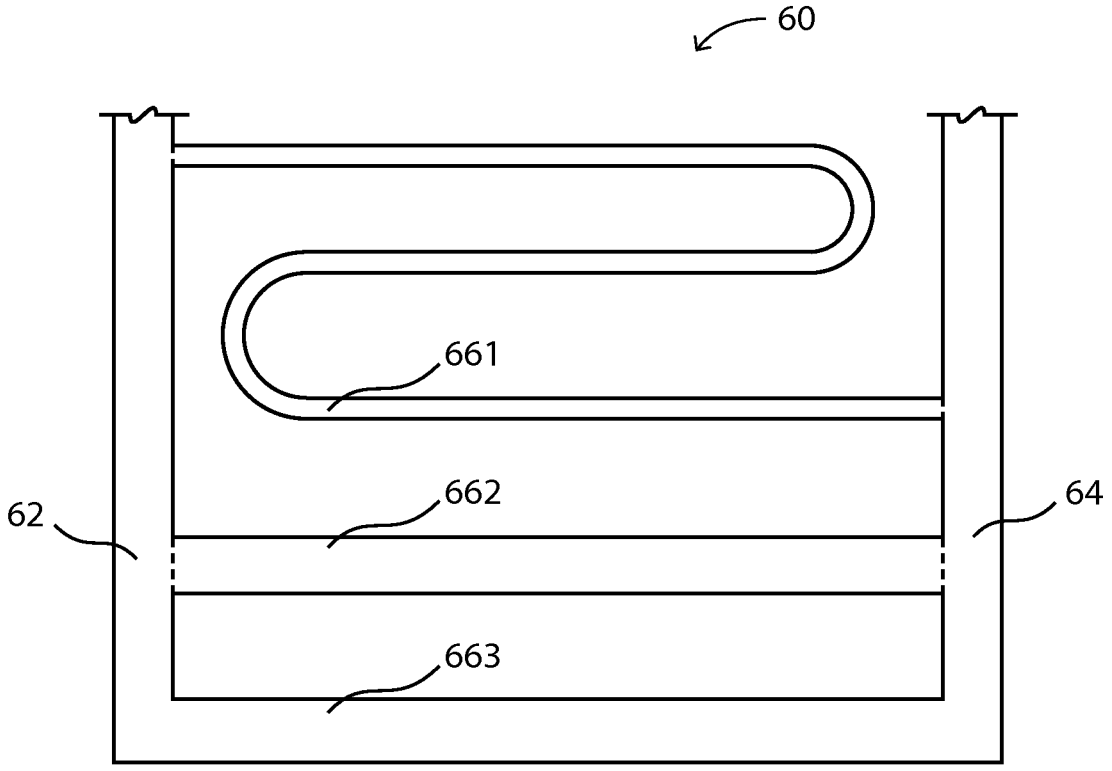
FIG. 6 includes an illustration of a top view of a heater having a heater element with a serpentine shape.

FIG. 6 includes an illustration of a top view of a heater 60 that has heater elements of different lengths. Bus bars 62 and 64 provide substantially the same functionality as the bus bars 22 and 24 in FIG. 2. Thus, the bus bars 62 and 64 are coupled to voltage terminals. In a particular configuration, the length of the resistive heater element 661 has a serpentine pattern and is significantly longer than the lengths of the resistive heater elements 662 and 663. In the embodiment as illustrated, the resistive heater element 661 has a serpentine pattern. In another embodiment, a different pattern can be used. The resistive heat element 661 has a lower heat flux capacity as compared to the resistive heater elements 662 and 663. The resistive heater elements 662 and 663 can have substantially the same length. The heat flux capacities of the resistive heater elements 662 ad 663 can be the same or different as compared to each other.

The configurations as illustrated in FIGS. 2 to 6 can be useful for particular applications. The heater 20 in FIG. 2 may be designed for use near the eave of a roof with the resistive heater element 264 closest to the eave as compared to the other resistive heater elements 261 to 263. The eave is one of the furthest points away from the interior of the structure, and thus, does not receive as much heat from the structure. The resistive element 264 helps to compensate for the relatively colder portion of the roof closest to an eave. The resistive heater element 261 may be closest to or overlie an interior of the structure. Thus, the resistive heater element 261 may provide some heat to supplement heat coming from the interior of the structure. The heater 30 in FIG. 3 may be useful where different portions of the roof intersect, such as near a valley. The configuration as illustrated in FIG. 3 helps to keep the lower portion of the corresponding roofing product from overheating, which may occur if each of the heater elements 361 to 363 had the same width.

The heater 40 in FIG. 4 may be useful along a valley or other location where roof portions intersect. When snow melts water flow may be locally higher within valleys, and therefore, the heater 40 can extend further away from the eaves. The heater section 486 may be closest to the eaves compared to each of the heater sections 482 and 484, and the heater section 482 may be closest to the ridge of the roof. The heater 40 may extend only partly and not completely to the ridge. The heater 50 in FIG. 5 that is configured to have and open area 58 between the heater elements to allow an object to be attached to or extend through the roof. The object extending through or attached to the roof can include a metal-containing material. For example, the object may be an iron sewer vent pipe, an aluminum wind turbine or housing for a power vent to vent the attic space below the roof, a metal frame for a skylight, or another similar object. When the object includes a metal-containing material, the object can be a good thermal conductor, and thus, when sunlight is not present, the roof may be locally colder near the object. Snow or ice may back up behind the object. The resistive heater element 561 can help to reduce the likelihood of causing an ice dam from forming where snow or ice may accumulate near the object.

With respect to FIG. 6, the heat flux capacities can be varied using different patterns. Length, width, and thickness can be used to adjust the resistance through the heater elements. The thickness can be increased or decreased; however, having a substantially uniform thickness for the resistive heater elements can simplify manufacturing and allow for a more uniform thickness profile of the roofing product. Thus, thickness may not be used to adjust for different resistances in some embodiments. As previously described in other embodiments, adjusting the width may be used to achieve different resistances. If the width of the resistive heater elements is too thin, a significant risk of discontinuity (that is, an electrical open) may occur. The length of the resistive heater element can be increased, and the width of the resistive heater element may be greater than the minimum width at which the likelihood of forming a discontinuity becomes significant. For example, the resistive heater element 661 may have approximately 3 times the length of the resistive heater elements 662 and 663, and have a width that is 1.2 times the minimum width at which the likelihood of forming a discontinuity becomes significant. Thus, the resistive heater element 661 has a resistance that is approximately 2.5 times a resistive heater element formed at the minimum width and having a length substantially equal to the resistive heater elements 662 and 663.

Many other configurations for a heater of a roofing product can be used without departing from the scope of the present invention. After reading the specification, skilled artisans will be able to desire particular heater configurations that meet the needs or desires for a particular application.

The roofing product can include any of the heaters as described herein. The roofing product can be an underlayment, a shingle, a membrane, or the like. The heater elements can be located over or under a substrate of the roofing product.

Any of the previously described heaters may be formed within or over a heater substrate. The heater substrate can provide sufficient mechanical support and withstand heating over normal operating temperatures without melting, delamination from the heater, or other adverse effect. In an embodiment, the heater substrate can be a sheet of a plastic material, for example, a polymer. The polymer can include a polyester, a polyamide, a polyimide, a polyether ether ketone, a polysulfone. In another embodiment, the heater substrate can include paper or a woven material, such as a polymer fabric, a cotton or wool fabric, or the like. In an embodiment, the heater substrate can have a thickness in a range of approximately 50 microns (2 mils) to approximately 500 microns (20 mils). In a further embodiment, the heater substrate may include any one or more of the substrate materials, have any of the thicknesses, or any combination thereof, as such materials and thicknesses are described in U.S. Pat. Nos. 5,038,018, 8,158,231, and WO 2012/139018A2, which are incorporated herein by reference in their entireties.

The heater substrate may be self-adhesive or not self adhesive. When the heater substrate is self-adhesive, a release sheet may be used when storing and transporting the heater substrate. The release sheet may be removed when attaching the heater substrate to a roofing article, such as a membrane or other underlayment, a shingle or other roofing article, or to a roofing deck. The adhesive material can include a silicone, a rubber, an acrylate, a bituminous adhesive, or the like. In a particular embodiment, a styrene-isoprene-styrene rubber composition can be used.

When the heater substrate is not self adhesive, mechanical fasteners, such as nails, cleats, or the like may be used to attach the heater substrate to a roof deck, a roofing article, or another suitable roofing object. Alternatively, a separate adhesive compound can be applied to the heater substrate or to a roof deck, a roofing article, or another suitable roofing object to which the heater substrate will be attached.

In another embodiment, the heater elements, the bus bars, or any combination thereof may be formed onto a roofing article without a separate heater substrate. In this embodiment, the heater substrate includes the roofing article. The roofing article can include a roofing substrate, such as fiberglass, polyester, paper, wood, another suitable roofing substrate material or any combination thereof. The roofing article, and thus, the heater substrate, may further include roofing-grade bitumen. The roofing-grade bitumen can be derived from petroleum asphalt, coal tar, recycled roofing product, processed bio oil (for example, vegetable or animal oil), another suitable bitumen source for a roofing article, or any combination thereof. In another embodiment, the roofing article can include a cementitious, ceramic, or a metal, and such roofing articles can be in the form of a tile, sheet metal, another suitable form for attachment to a roof deck, lathes, or slats.

The heater substrate has a thickness sufficient to support the heater elements during the fabrication process and withstand normal shipping, handling, and installation of roofing products. Although there is no theoretical upper limit on the thickness of the heater substrate, practical considerations can limit the thickness of the heater substrate. In an embodiment, the thickness of the heater substrate can be at least approximately 0.01 mm, at least approximately 0.11 mm, at least approximately 0.3 mm, or at least approximately 1.1 mm, and in another embodiment the heater substrate may be no greater than approximately 9 mm, no greater than approximately 5 mm, no greater than approximately 1 mm, or no greater than approximately 0.5 mm. When the heater substrate includes a plastic sheet, the thickness can be in a range of approximately 0.11 mm to approximately 0.5 mm, and where the heater substrate includes a roofing article or a part of a roofing article, the heater substrate can have a thickness in a range of approximately 1 mm to approximately 5 mm.

The heater elements as described above can include an electrically resistive ink, an electrically resistive polymer, metal or metal alloy particles, a metal or a metal alloy oxide, another suitable electrically resistive material or layer, or any combination thereof. In a non-limiting embodiment, the electrically resistive ink can include carbon, such as graphite in a binder. An example of such an electrically resistive ink is described in U.S. Pat. No. 4,485,297, which is incorporated herein by reference in its entirety. An electrically resistive polymer can include polypyrrole, polyaniline, poly (3,4-ethylenedioxythiophene) ("PEDOT"). The polymer can be sulfonated, if needed or desired, to achieve a particular resistivity. The metal or metal alloy particles may be dispersed within a binder. The metal or metal alloy oxide can include a doped zinc oxide, a ruthenium oxide, a rhodium oxide, an osmium oxide, an iridium oxide, a doped indium oxide, an indium tin oxide, another suitable resistive oxide, or any combination thereof. In another embodiment, a carbon or graphite coated fiber may be used, such as described in U.S. Pat. No. 4,733,059, which is incorporated herein by reference in its entirety. In a further embodiment, the heater elements may be in the form of a patterned metal layer, such as described in U.S. Pat. No. 5,019,797, which is incorporated herein by reference in its entirety.

The thicknesses, lengths, and widths of and spacings between the heater elements can depend on the material used for the heater elements, heat flux, and electrical considerations. The thicknesses of the heater elements can be any of the thicknesses as described with respect to the thicknesses of the heater substrate. In another embodiment, the thicknesses of the heater elements can be at least 0.02 mm. The thicknesses of the heater elements can be thinner than the thickness of the heater substrate. In a particular embodiment, the thicknesses of the heater elements are in a range of approximately 0.02 mm to approximately 2 mm. The thicknesses of the heater elements can be substantially uniform or the thickness of any particular heater element may be different from the thickness of at least one other heater element.

The length of the heater elements may be selected based on the particular application or where on the roof the roofing product is intended to be installed. If the roofing product is installed in a valley, the length of the heater may be no longer than the valley. If the roofing product is a shingle, the length of the heater may be no longer than the shingle. If the roofing product is installed along the eaves of a structure, the length of the heater may be no longer than the longest linear section of the eaves. The length of the heater elements may be no greater than the length of the heater. In another embodiment, the length of heater element may have a length longer than the length of the heater, such as illustrated for resistive heater element 661 in FIG. 6. In an embodiment, the length of the heater element can be at least approximate 2 cm, at least approximately 11 cm, or at least approximately 50 cm, and in another embodiment, the length of the heater element may be no greater than approximately 500 cm, no greater than approximately 200 cm, or no greater than approximately 150 cm. In an embodiment, the length of the heater element is in a range of approximately 11 cm to approximately 150 cm, and in a particular embodiment, the length of the heater element is in a range of approximately 50 cm to approximately 90 cm.

For many applications, the widths of the heater elements and the spacing between the heater elements are used to determine the heat flux that is to be provided. When the composition, length, and thickness of the heater elements are substantially the same, the sum of the widths of the heater elements can be adjusted to achieve a resistance that is needed or desired for a particular application. For a particular application, 1200 watts of power is produced by the heater, and the resistance of the heater may be approximately 12 ohms for a 120 V power supply. The heater may have three heater elements in which a first heater element has a resistance that is double the resistance of a second heater element, which is double the resistance of a third heater. The first heater element can have a resistance of approximately 84 ohms and produce approximately 171 watts of power, the second heater element can have a resistance of approximately 42 ohms and produce approximately 343 watts of power, and the third heater element can have a resistance of approximately 21 ohms and produce approximately 686 watts of power. Thus, the width of third heater element is double the width of the second heater element, which is double the width of the first heater element.

In an embodiment, the width of a heater element can be at least approximately 0.11 cm, at least approximately 0.2 cm, or at least approximately 0.5 cm, and in another embodiment, the width of the heater element may be no greater than approximately 50 cm, no greater than approximately 9 cm, or no greater than approximately 5 cm. In an embodiment, the width of the heater element can be in a range of approximately 0.2 cm to approximately 9 cm, and in a particular embodiment, the width of the heater element can be in a range of approximately 0.5 cm to approximately 3 cm. Different widths of heater elements can be used, as this can allow different amounts of power to be dissipated through different elements. In another embodiment, some or all of the heater elements may have substantially the same width.

The spacing between heater elements can affect the heat flux. Substantially identical heater elements may be closely spaced and produce a heat flux that is greater than other substantially identical heater elements that are spaced farther apart from each other. The spacing between heater elements should not be such that substantially no heat can be detected at a location between the heater elements if heat is to be provided at such a location. In an embodiment, the spacing between the heater elements can be at least approximately 0.11 cm, at least approximately 0.2 cm, or at least approximately 0.5 cm, and in another embodiment, the spacing between the heater elements may be no greater than approximately 50 cm, no greater than approximately 9 cm, or no greater than approximately 5 cm. In an embodiment, the spacing between the heater elements can be in a range of approximately 0.2 cm to approximately 9 cm, and in a particular embodiment, the spacing between the heater elements can be in a range of approximately 0.5 cm to approximately 3 cm. Different spacings can be used. In another embodiment, some or all of the spacings may be different.

After reading this specification, skilled artisans will be able to model and design heaters to achieve needed or desired heat fluxes and electrical characteristics. In many embodiments, the widths of the heater elements, spacings between heater elements, or a combination thereof may be used as a variable to achieve performance and electrical characteristics, as these are relatively easy to implement in the layout of the heater. In other embodiments, the lengths, thicknesses, or compositions of the heater elements can be used as a variable to achieve the performance and electrical characteristics.

The bus bars as described above can be substantially more conductive than the heater elements. The bus bars can include aluminum, copper, gold, silver, another suitable conductive material, or any combination thereof. In an embodiment, the width of a bus bar can be at least approximately 0.11 cm, at least approximately 0.2 cm, or at least approximately 0.5 cm, and in another embodiment, the width of the bus bar may be no greater than approximately 9 cm, no greater than approximately 5 cm, or no greater than approximately 3 cm. In an embodiment, the width of the bus bar can be in a range of approximately 0.5 cm to approximately 5 cm, and in a particular embodiment, the width of the bus bar can be in a range of approximately 1 cm to approximately 3 cm. The bus bars can have substantially the same or different widths.

The bus bars may include a diffusion barrier layer if a reaction or other interaction between a material in the bus bars and a material in the heater elements or an adhesive, or heater substrate may occur. The diffusion barrier layer can include a conductive metal nitride, such as titanium nitride, tantalum nitride, tungsten nitride, a metal-Group 14 nitride, or any combination thereof. The diffusion barrier layer may have a resistivity between a resistivity the metal or metal alloy that is the principal material within the bus bars and a resistivity of the heater elements. The thickness of the diffusion barrier layer should be sufficiently thick to perform adequately as a diffusion barrier but not so thick as to significantly increase the resistance of the bus bars. In an embodiment, the thickness of the diffusion barrier layer can be at least approximately 2 nm, at least approximately 11 nm, or at least approximately 20 nm, and in another embodiment, the thickness may be no greater than approximately 9000 nm, no greater than approximately 5000 nm, or no greater than approximately 900 nm. In a particular embodiment, the thickness is in a range of approximately 5 nm to approximately 2000 nm, or more particularly, in a range of approximately 20 nm to approximately 900 nm.

If needed or desired, a solder, or a conductive adhesive may be used between the bus bars and their corresponding heater elements. In a particular embodiment, the conductive adhesive can include a metal-filled epoxy, such as a silver-filled epoxy. In another embodiment, the conductive adhesive can include an interposer with z-axis conductors.

The heater elements may be disposed between the heater substrate and the bus bars. In another embodiment, the bus bars may overlie the heater substrate before the heater elements are formed or placed over portions of the heater substrate and bus bars.

Different fabrication methods may be used to forming the roofing product that includes the heater, which may in part depend on the material used for the heater substrate. In one set of embodiments, the heater can be formed onto a plastic sheet or other similar heater substrate. In another set of embodiments, the heater may be formed onto a roofing article, such as a roofing membrane or shingle, or other similar heater substrate.

Figure 7:
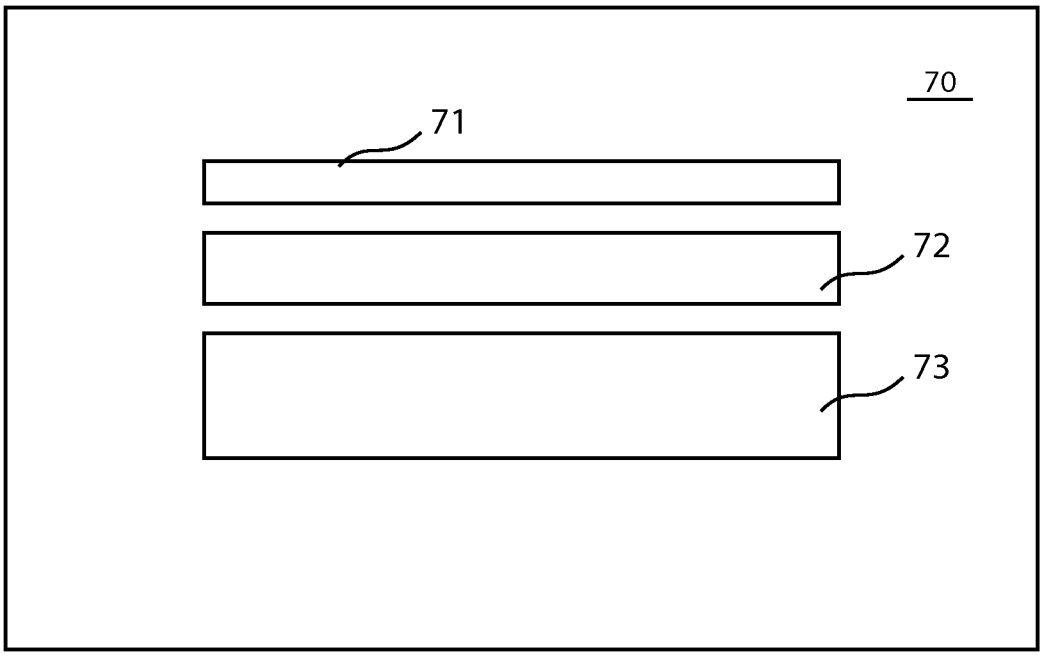
FIG. 7 includes an illustration of a top view of a heater substrate and heater elements.

The heater elements can be formed on or within the heater substrate using a variety of techniques. In an embodiment illustrated in FIG. 7, heater elements 71, 72, and 73 can be formed onto a heater substrate 70 using a printing technique. In particular, the heater elements can be printed using a stencil printing technique, such as screen printing or a deposition technique using a shadow mask. In a more particular embodiment, screen printing can be performed using a rotary object, such as a printing drum, that includes features corresponding to the heater elements 71 to 73, which have different dimensions. The heater elements can be formed in a repetitious pattern over the heater substrate 70 using a continuous process. In another more particular embodiment, a stencil mask can be placed adjacent to the heater substrate 70, where the openings in the stencil mask corresponds to locations where the heater elements 71 to 73 are to be formed. A layer is deposited over the stencil mask and the heater substrate 70. The heater elements 71 to 73 are formed on the heater substrate 70 and have shapes that correspond to the openings in the stencil mask.

In another particular embodiment, a printer is programmed to selectively dispense an electrically resistive ink. In a more particular embodiment, the printer can include a printing head that can dispense an electrically resistive ink. In a particular embodiment, more than one printing head may be used. A plurality of printing heads can be useful to print a plurality of heater elements substantially simultaneously. In another embodiment, at least two different printing heads have different compositions that have different electrical resistivities. The different electrical resistivities can be useful to allow heater elements to have more uniform dimensions and still have different resistances for the heater elements. For example, the heater elements 71 to 73 could be modified to have widths that are within approximately 9%, within approximately 5%, or even within 2% of each other, and still allow the heater element 71 to have a substantially higher resistance as compared to each of the heater elements 72 and 73. In another embodiment, the printing head can raster across the heater substrate during printing. Printing techniques are well suited for forming the heater elements because the pattern for the heater elements can be repeated, and a relatively continuous heater substrate can be used and later cut or otherwise separated into a needed or desired size.

In a further embodiment, the heater elements 71 to 73 can be formed by coating or otherwise depositing an electrically resistive layer over the heater substrate 70, and patterning the electrically resistive layer to define the heater elements 71 to 73. In still another embodiment, the heater elements 71 to 73 can be formed separately from the heater substrate 70 and placed over the heater substrate 70.

Figure 8:
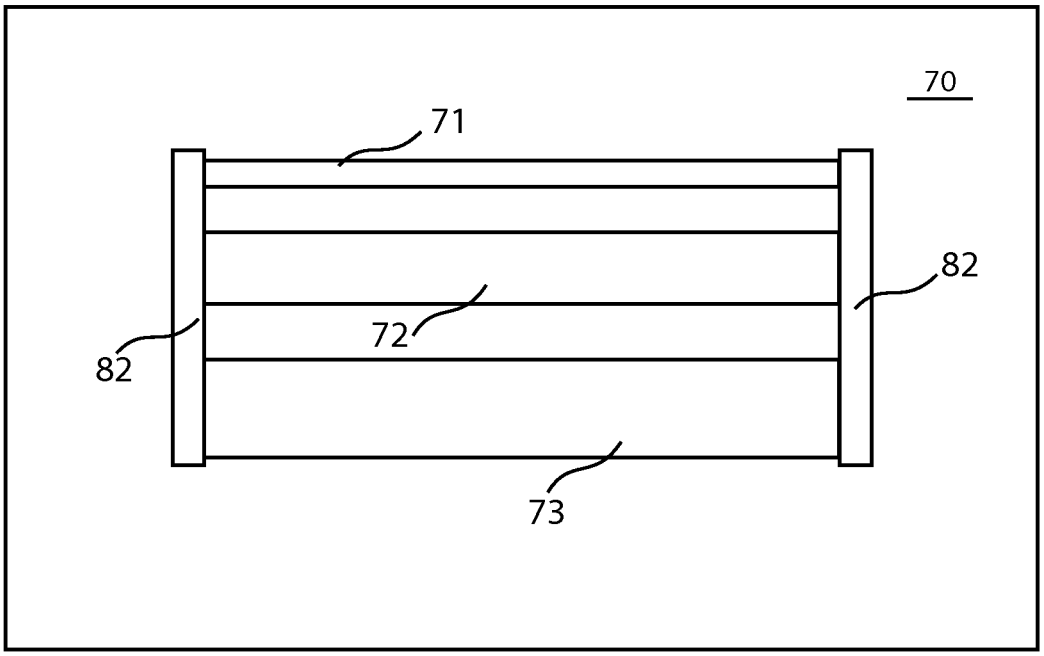
FIG. 8 includes an illustration of the heater substrate and heater elements of FIG. 7 after forming a conductive adhesive over portions of the heater substrate and heater elements.

If needed or desired, a conductive adhesive 82 can be applied, as illustrated in FIG. 8. The conductive adhesive 82 can help the subsequently-formed bus bars to adhere to the heater substrate 70, the heater elements 71 to 73, or any combination thereof. The conductive adhesive 82 can be any of the conductive adhesive compounds as previously described.

Figure 9:
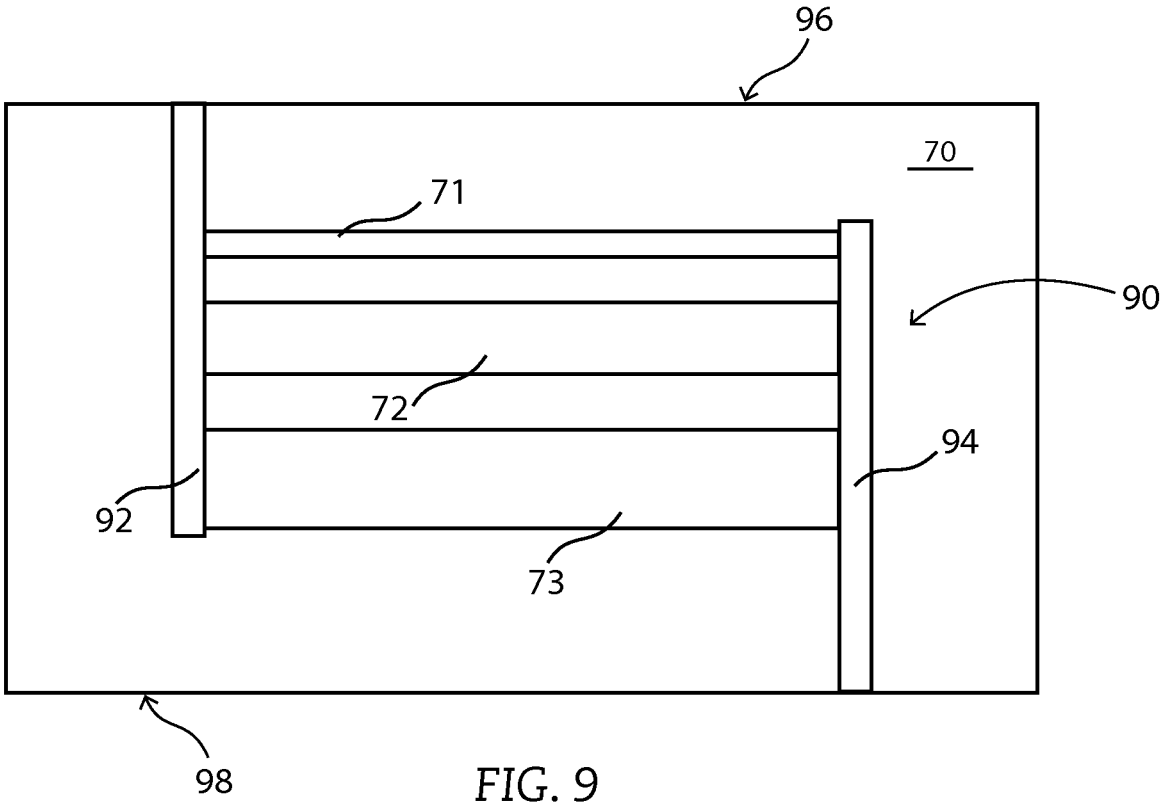
FIG. 9 includes an illustration of the heater substrate and heater elements of FIG. 8 after forming bus bars along opposite ends of the heater elements.

Bus bars 92 and 94 are formed over the heater substrate 70, as illustrated in FIG. 9. The bus bars 92 and 94 provide current that powers the heater 90. The bus bar 92 can be electrically connected to a terminal that is part of or coupled to a power supply, and the bus bar 94 can be electrically connected to a different terminal that is part of or coupled to the power supply. The embodiment as illustrated in FIG. 9 has the bus bars 92 and 94 extending to the opposite edges 96 and 98 of the heater substrate 70, so electrical connections can be readily made to the bus bars 92 and 94. In another embodiment, the bus bars 92 and 94 may extend toward the edge 96 or 98 of the heater substrate 70.

In still another embodiment, the bus bar 92, the bus bar 94, or both may not extend to an edge of the heater substrate 70. In a particular embodiment, the heater substrate 70 can include a conductor within or along an opposite surface of the heater substrate 70, wherein the length of the conductor is oriented in a direction different from a length of a corresponding bus bar to which the conductor is electrically coupled or connected. In a more particular embodiment, a conductor may have a length oriented substantially perpendicular to the length of and be electrically connected to the bus bar 92. Such conductor can be within or under the heater substrate 70 near the edge 96. Another conductor may have a length oriented substantially perpendicular to the length of and be electrically connected to the bus bar 94. Such other conductor can be within or under the heater substrate 70 near the edge 98. Vias can be used to electrically connect the bus bars 92 and 94 to their corresponding conductors.

In another embodiment, the conductive adhesive 82 may be applied to the bus bars 92 and 94, rather than the heater substrate 70 and heater elements 71 to 73. The bus bars 92 and 94 with the conductive adhesive 82 can be attached to the heater substrate 70 and heater elements 71 to 73. In still another embodiment, a non-conductive adhesive may be used. Such an adhesive may be at locations between the heater elements 71 to 73, so that the bus bars 92 and 94 adhere to the heater substrate 70. The bus bars 92 and 94 can be electrically coupled to the heater elements 71 to 73 by physical contact, solder, an interposer with z-axis conductors, or the like.

In still another embodiment, the order of formation of the heater elements 71 to 73 and bus bars 92 and 94 may be reversed. The bus bars 92 and 94 may be formed within or over the heater substrate 70, and the heater elements 71 to 73 may be formed or placed over portions of the heater substrate 70 and the bus bars 92 and 94.

Figure 10:
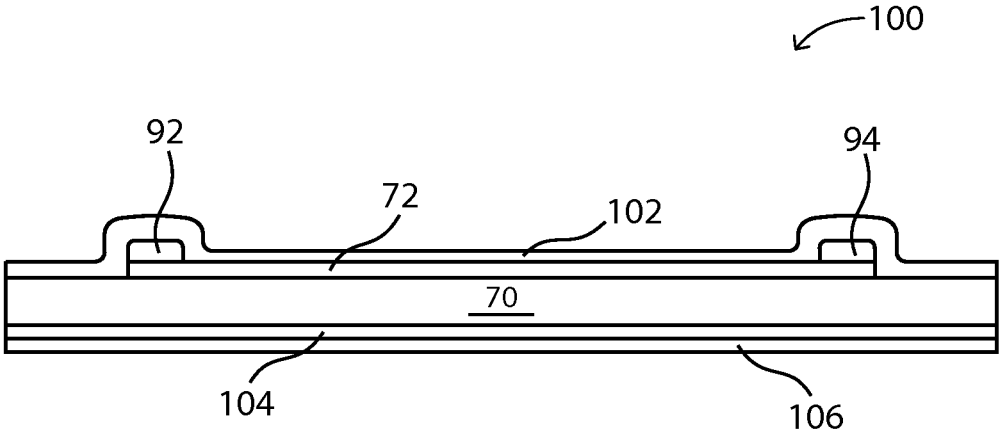
FIG. 10 includes an illustration of a cross-sectional view of a roofing product as illustrated in FIG. 9.

FIG. 10 includes a cross-sectional illustration, as sectioned through heater element 72, of substantially completed roofing product 100 in accordance with an embodiment. A protective layer 102 can be formed or placed over the bus bars 92 and 94. The protective layer 102 can help to reduce the likelihood of damage to the heater during subsequent fabrication, if any, handling, shipping, installation, or the like. The protective layer 102 can include any of the materials as described with respect to the heater substrate. The protective layer 102 and the heater substrate 70 can be made of substantially the same or different materials. A pressure-sensitive adhesive 104 can be applied along a principal surface of the heater substrate 70 opposite the heater element 72, bus bars 92 and 94, or any combination thereof. The pressure-sensitive adhesive 104 includes an adhesive material that can include a silicone, a rubber, an acrylate, a bituminous adhesive, or the like. In a particular embodiment, a styrene-isoprene-styrene rubber composition can be used. A release sheet 106 can be placed along the pressure-sensitive adhesive 104 to protect pressure-sensitive adhesive 104 during storage and shipping. When the roofing product is ready to be installed, the release sheet 106 can be removed, and the roofing product 100 can be properly oriented to the roof at a desired location. The roofing product 100 is installed by placing the pressure-sensitive adhesive 104 adjacent to a surface (for example, a roofing deck or a roofing article) to which the roofing product 100 is to be installed, and pressing roofing product 100 against the surface.

In another embodiment, a roofing product may not be self-adhesive, and thus, the pressure-sensitive adhesive 104 and release sheet 106 may not be present. To reduce the likelihood that adjacent roofing products stick to each other during shipping, a parting agent, such as sand, talc, or the like, may be applied along the principal surface where the pressure-sensitive adhesive would otherwise be located. Alternatively or in addition to the parting agent, a sheet or other separator may be placed between adjacent roofing products.

The roofing product 100 may be installed onto a roofing deck or a roofing article already installed onto a roofing deck. When the roofing product 100 includes the pressure sensitive adhesive 104, the roofing product 100 can be oriented to a desired location and then pressed such that the pressure-sensitive adhesive 104 adheres to the surface to which the roofing product 100 is being attached. In another embodiment, the roofing product may not include the pressure-sensitive adhesive 104, the roofing product can be installed using a fastener, such as a nail, a clamp, a staple, a screw, another suitable roofing fastener, or the like. The fastener can be used when the roofing product 100 includes the pressure-sensitive adhesive 104. Such a fastener can be useful when the roofing product 100 is being installed at a relatively cold temperature at which the pressure-sensitive adhesive 104 does not provide sufficient adhesion. The fastener can hold the roofing product 100 in place until the roofing product 100 is warm enough for the pressure-sensitive adhesive to provide sufficient adhesion. In still a further embodiment where a roofing product does not include the pressure-sensitive adhesive 104, an adhesive compound may be applied to the roofing product or to a surface of the roofing deck or roofing article to which the roofing product is being installed. After the roofing product is oriented to a desired location, and roofing product is pressed against the surface, and the adhesive adheres to both the roofing product and the surface.

Figure 11:
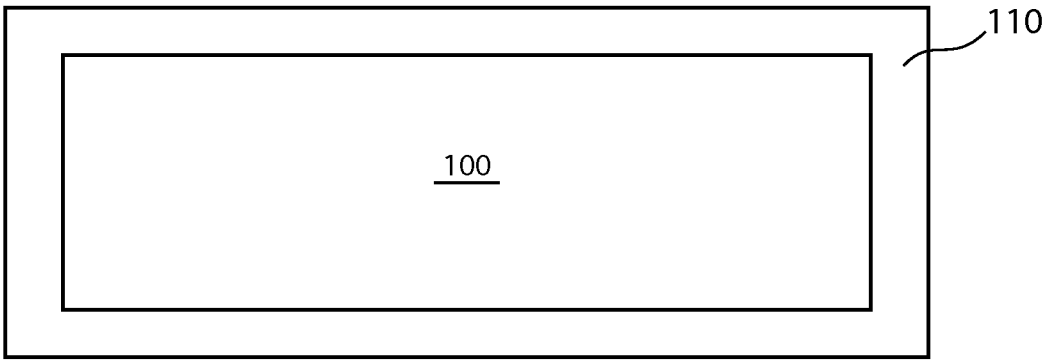
FIG. 11 includes an illustration of a top view of the roofing product of FIG. 10 attached to a roofing article.
Figure 12:
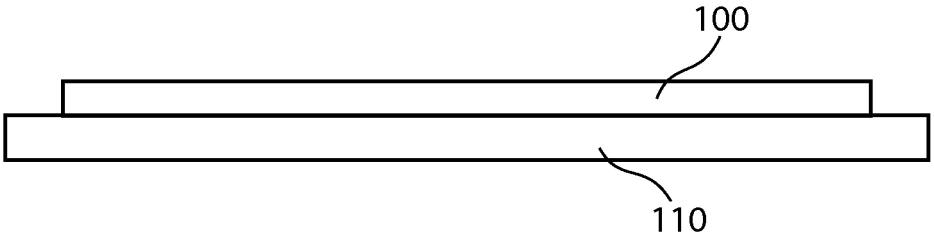
FIG. 12 includes an illustration of a cross-sectional view of the roofing product and roofing article of FIG. 11.

In still another embodiment, the roofing product can be attached to a roofing article at a site remote to the structure to which the roofing product will be installed. FIGS. 11 and 12 include a cross-sectional view and a top view, respectively, in which the roofing product 100 is attached to a roofing article 110. In this embodiment, the roofing article 110 can be a roofing membrane. The roofing product 100 may be attached to the top (illustrated in FIG. 12) or the bottom of the roofing article. A pressure-sensitive adhesive and a release sheet (not illustrated in FIG. 11), similar to the pressure-sensitive adhesive 104 and release sheet 106, may be located along the principal surface of the roofing article 110 opposite the roofing product 100. In another embodiment, the pressure-sensitive adhesive and a release sheet may be located along the principal surface having the roofing product 100. In another embodiment, no adhesive or release sheet may be used for either embodiment (roofing product 100 along the top or bottom of the roofing article 110), and a fastener or a separate adhesive compound may be used similar those previously described with respect to the roofing product and a corresponding surface during installation.

Figure 13:
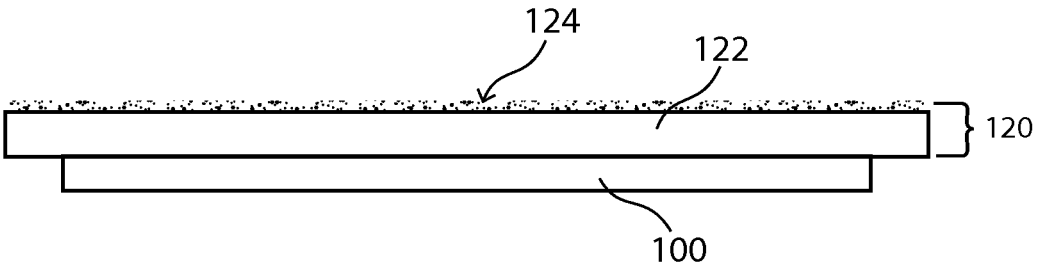
FIG. 13 includes an illustration of a cross-sectional view of a roofing product and a roofing article in accordance with another embodiment.

In a further embodiment, the roofing article 120 can be a roofing shingle that includes a body 122 and roofing granules 124 as illustrated in FIG. 13. The body 122 can include a roofing substrate (for example, paper, wood, a fiberglass mat, polyester, or the like); a bituminous material (petroleum asphalt, a modified bio oil, recycled roofing articles, or the like); and a filler (for example, limestone, talc, or the like). The roofing product 100 can be located along a principal surface of the roofing article 120 opposite the roofing granules 124. A pressure-sensitive adhesive and a release sheet (not illustrated in FIG. 13), similar to the pressure-sensitive adhesive 104 and release sheet 106, may be located along the principal surface having the roofing product 100. In another embodiment, no adhesive or release sheet may be used, and a fastener or a separate adhesive compound may be used similar to those previously described with respect to the roofing product and a corresponding surface during installation.

The roofing products as previously described can be installed over a roof deck, wherein the roofing products can have different heat flux capacities. A higher heat flux can provide more heat to a particular area of the roof as compared to a lower or no heat flux. For example, ice may be more likely to form adjacent to the eaves or along valleys. In the embodiments described below, a heater can include a single heater element or may include a plurality of heater elements.

Figure 14:
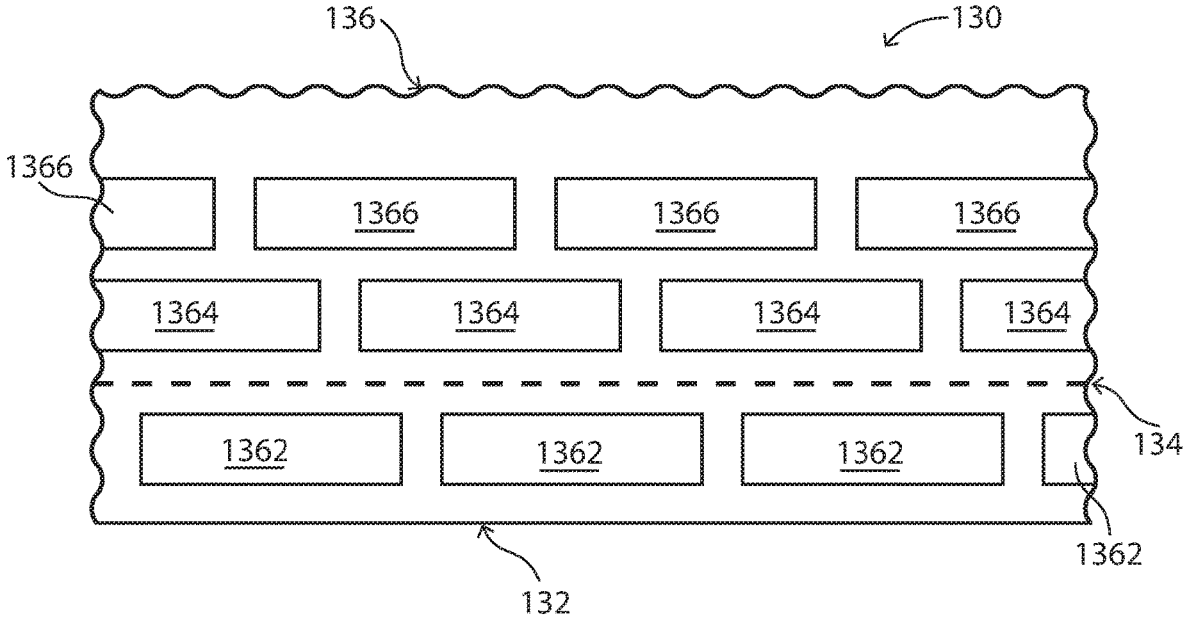
FIG. 14 includes an illustration of a top view of a portion of a roof, wherein a roofing product has heater elements adjacent to an eave of a roof.

FIG. 14 includes an illustration of a roof 130 that includes a roofing product 136 that has a heater. The roofing product 136 is installed over a roofing deck along an eave 132 of the roof 130. As seen from a top view of the roof 130, the roofing product 136 extends past a location corresponding to the exterior wall of the structure, which is illustrated as dashed line 134. The roofing product 136 is configured such that a greater heat flux is provided closer to the eave 132 and less further from the eave 132. The portion of the heater with the heaters 1362 have higher heat flux capacities as compared to the heaters 1364, which have higher heat flux capacities as compared to the heaters 1366. During normal operation, heaters 1362 provide more heat as compared to heaters 1364 and 1366, and heaters 1364 provide more heat as compared to the heaters 1366. In an embodiment, more heaters (not illustrated) may be located further from the eave, and in another embodiment, no heaters may lie long the side of the heaters 1366 opposite the side closer to the heaters 1364.

Figure 15:
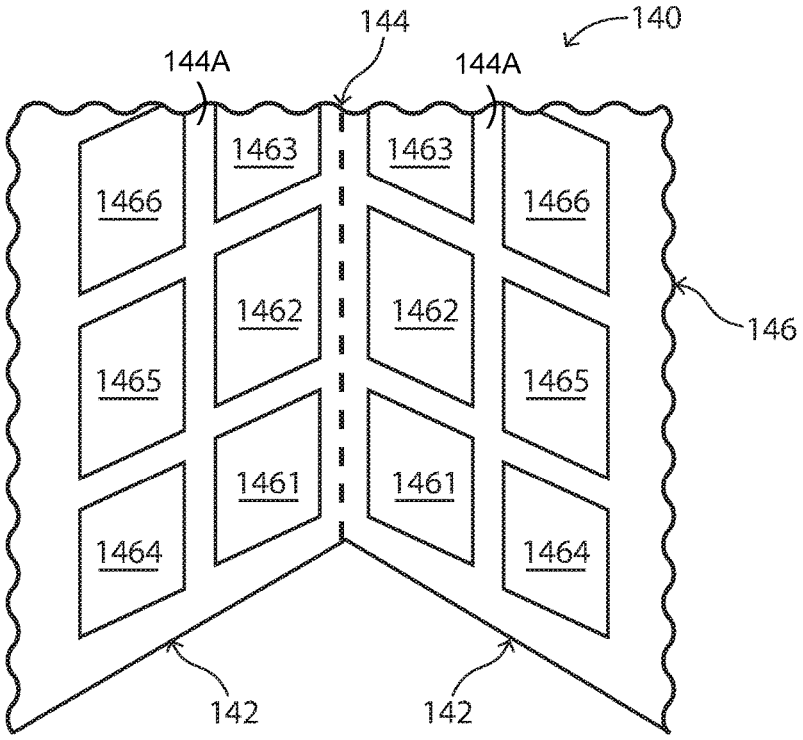
FIG. 15 includes an illustration of a top view of portions of a roof, wherein a roofing product has heater elements adjacent to an intersection of portions of the roof.

FIG. 15 includes an illustration of a roof 140 that includes a roofing product 146 that has a heater. The roofing product 146 is installed over a roofing deck along an intersection of two different portions of the roof 140. The intersection 144 defines a centerline, as illustrated by a dashed line 144 in FIG. 15. In an embodiment, the centerline corresponds to a valley that extends from the eaves 142 up towards a higher elevation of the roof 140. The roofing product is configured such that a greater heat flux is provided closer to the valley and eaves 142 and less heat flux capacity farther from the eaves 142 and the valley. Thus, a portion of the heater having heaters 1461 can have higher heat flux capacities compared to any or all other illustrated heaters, including heaters 1462 (located at a higher elevation) and heaters 1464 (located farther from the intersection 144), and a portion of the heater having heaters 1466 can have lower heat flux capacities compared to any or all other illustrated heaters, including heaters 1465 (located at a lower elevation) and heaters 1463 (located closer from the intersection 144). As compared to the other heaters illustrated, the portions of the heater having heaters 1463 and 1465 may have the heat flux capacities intermediate to those of the heaters 1461 and 1466. The spacing between the columns of heaters along the same portion of the roof (on the same side of the intersection 144)

can allow for a nail zone 144*a*. The dimensions of the heaters as measured in a direction from the eave 142 to the top of the roof 140 can be longer than a course of shingles.

During normal operation, heaters 1461 provide more heat as compared to other heaters illustrated in FIG. 15, and heaters 1466 provide less heat as compared to the other heaters illustrated in FIG. 15. In an embodiment, more heaters (not illustrated) may be located further from the eave, and in another embodiment, no heaters may lie long the side of the heaters 1466 opposite the side closer to the heaters 1464.

In the embodiments as illustrated in FIGS. 14 and 15, some of the heaters may be replaced by a single heater that occupies more area than a heater that such a single heater replaces. For example, two or more of the heaters 1362 may be replaced by a single heater having substantially the same heat flux capacity as the heaters 1362. Similarly, two or more of the heaters 1364 may be replaced by a single heater, or two or more of the heaters 1366 may be replaced by a single heater.

Different shapes of heaters may be achieved when replacing a larger heater with smaller heaters. For example, heaters 1461, 1462, and 1464 on each side of the intersection 144 may be replaced with L-shaped heaters. Care may need to be used to ensure nails or other fasteners are not driving through heater elements, bus bars, or other electrical components for the heaters. In another embodiment, heaters 1462 and 1464 on each side of the intersection 144 may be replaced by heaters that lie along diagonal directions as compared to the eaves. In further embodiment, more heaters than illustrated may be used. After reading this specification, skilled artisans will be able to determine the number of heaters and size for their particular application.

Figure 16:
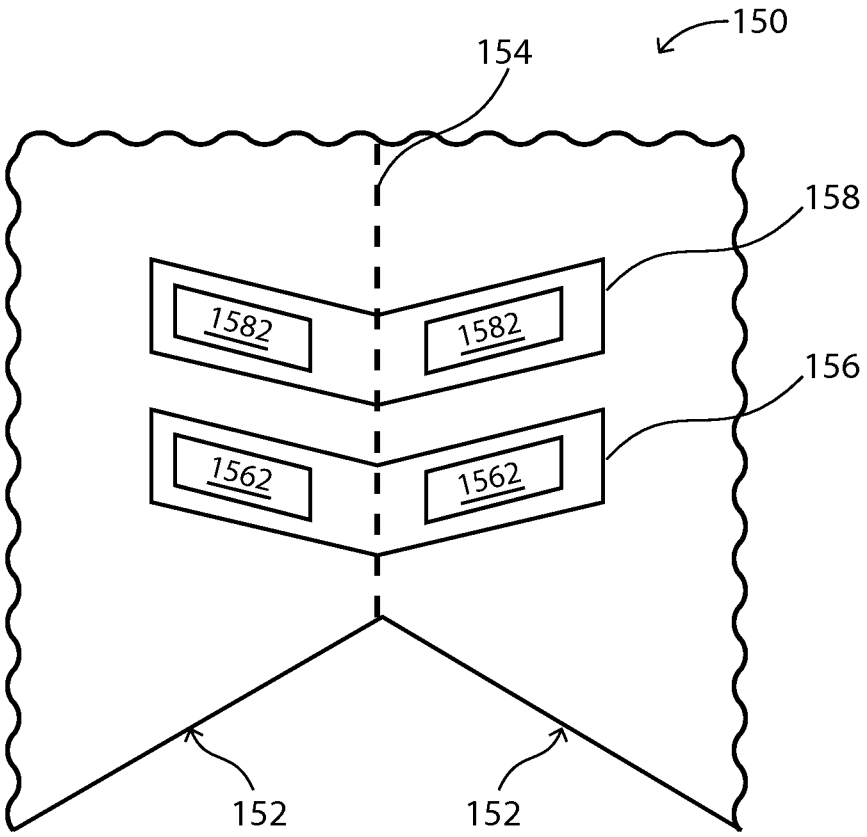
FIG. 16 includes an illustration of a top view of portions of a roof, wherein a roofing product has heater elements adjacent to an intersection of the portions of the roof in accordance with another embodiment.

FIG. 16 includes an illustration of a roof 150 that includes roofing products 156 and 158 that have a heater. The roofing product 156 is installed over a roofing deck along an intersection of two different portions of the roof 150. The intersection defines a centerline, as illustrated by a dashed line 154 in FIG. 16. In an embodiment, the centerline corresponds to a valley that extends from the eaves 152 up towards a higher elevation of the roof 150. The roofing products 156 and 158 are configured such that a greater heat flux is provided closer to the eaves 152 and less heat flux capacity farther from the eaves 152. Thus, the roofing product 156 has heaters 1562 that have higher heat flux capacities compared to heaters 1582 in the roofing product 158. During normal operation, heaters 1562 provide more heat as compared to the heaters 1582.

In another example, a metal containing object may extend through or be attached to the roof, wherein at least a portion of the metal-containing object is exposed and overlies a plane defined by the roof. Ice can form on or behind objects, such as a wind or power turbine, skylight, metal flashing for a chimney, vent pipe or the like. The roof may not need as much heat on the lower side of the metal-containing object because the flow of water from melting ice may be less impeded as compared to above the metal-containing object. The roofing product can be installed such that a heater provides more heat above the object as compared to below the object.

Figure 17:
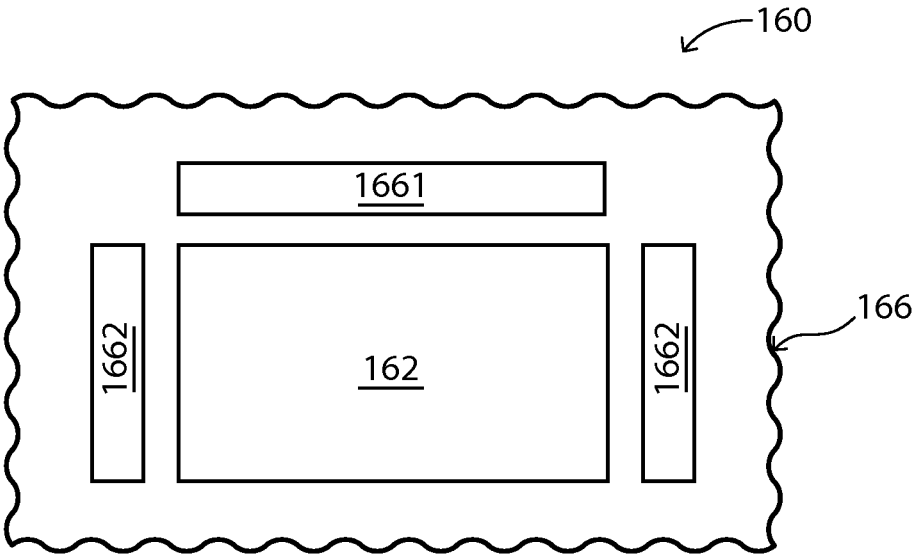
FIG. 17 includes an illustration of a top view of a skylight and a roofing product having heater elements adjacent to the skylight.

FIG. 17 includes an illustration of a top view of a roofing product 166 that is installed around a skylight 162 that extends through a roof 160. The portion of the roof closer to the bottom of the illustration in FIG. 17 is closer to an eave of the roof 160. Snow or ice is more likely to build up along a side of the skylight 162 farther from the eave. The roofing product 166 includes a portion having a heater 1661 that has a higher heat flux capacity as compared to portions having heaters 1662. In the embodiment as illustrated, no heater is located along the side of the skylight 162 closest to the eave. During normal operation, the heater 1661 provides more heat as compared to the heaters 1662. Thus, the heater 1661 is well suited to prevent the build up or melt ice reasonably quickly from behind the skylight 162. The heaters 1662 help to keep the melted ice from re-freezing, as exposed metal from the skylight may cause refreezing in the absence of the heaters 1662. A heater may not be present on the side of the skylight 162 opposite the heater 1661 as melted ice should flow substantially unimpeded away from the skylight 162. Heaters, such as those in the heaters in the roofing product 136 in FIG. 14, may be present between the eave and the skylight 162, but their presence would be for reasons unrelated to the skylight. In another embodiment, the pitch of the roof 160 in FIG. 17 may be relatively shallow, and in this embodiment, a heater may be located along the side of the skylight 162 opposite the heater 1661 to reduce the likelihood of the melted ice refreezing near the skylight 162.

Figure 18:
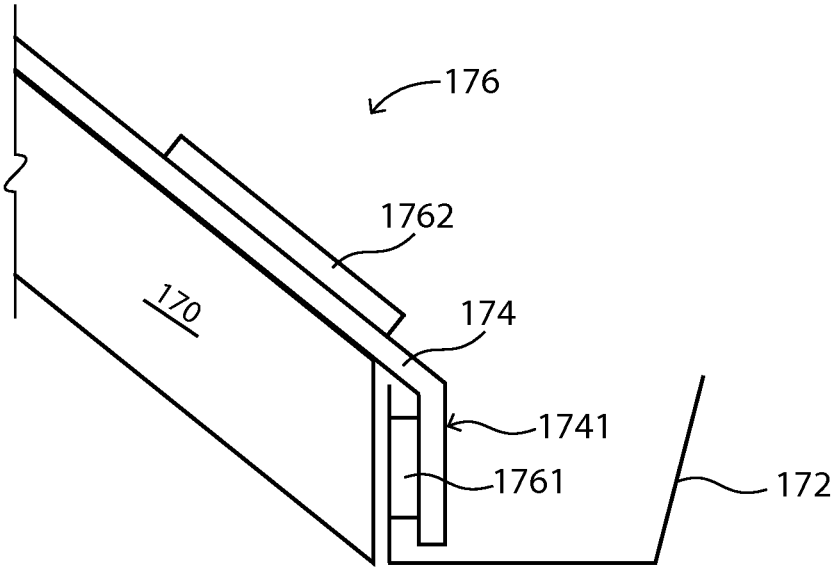
FIG. 18 includes an illustration of a cross-sectional view of a portion of a roof, a gutter, and a roofing product having heater elements.

FIG. 18 includes an illustration of a cross-sectional view of portions of a structure 170, a gutter 172, and a roofing product 176. The structure 170 can include rafters, roof decks, lathes, fascia boards, soffit boards, or the like. The gutter 172 is attached to the structure at a fascia board, rafters, or the like at a location not illustrated in FIG. 18. The gutter 172 and its associated downspout (not illustrated) can be made of metal and have a relatively high thermal conductivity as compared to each of wood, plastic, and bitumen. The higher thermal conductivity may allow water that runs off the roof to become ice in the gutter 172 or downspout when the air temperature is below 0° C. A heater can be used to heat the gutter 172, downspout, or both to reduce the likelihood of ice forming or to reduce the amount of ice that has formed within the gutter 172 or downspout.

The roofing product 176 includes an overhang section 1741 that has been folded over the edge of the roof 170 and is coupled to an object beyond the edge of the roof 170, such as the gutter 172. The roofing product includes a substrate 174 and heaters 1761 and 1762. The heater 1761 is thermally coupled to the gutter 172, and the heater 1762 can be over the roof 170 and adjacent to an eave or valley of the roof 170. In a particular embodiment, the portion of the roofing product 176 adjacent to the heater 1761 can have a higher flux capacity as compared to another portion of the roofing product 170 adjacent to the heater 1762. In the embodiment as illustrated, the heaters 1761 and 1762 are disposed along opposite principal surfaces of the substrate 174. The portion of the downspout that connects to the gutter 172 may also be heated by the heater 1761 or another heater of the roofing product 176. Thus, the embodiment reduces the likelihood that the gutter will be filled with ice, and therefore, the gutter 172 will be less likely to be pulled away from the structure 170 as snow or ice melts and refreezes in the gutter, downspout, or the like.

The roofing products as disclosed herein can allow for different amounts of heat to be applied to different portions of the roof to reduce the likelihood of forming an ice dam. Further, the energy consumed by the roofing products can be less because areas of the roof that do not need as much heat are designed to produce less heat in such areas. Thus, the heat flux can be tailored for the particular application. The roofing products can be fabricated using many different techniques, and thus, the methods of making the heaters can be tailored to the particular roofing product compositions and use equipment compatible to such roofing products and their associated fabrication processes.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the items as listed below.

Item 1. A roofing product can include a substrate and a heater disposed along a principal surface of or within the substrate. The heater can includes a first area including a first portion of the heater, wherein the first area has a first heat flux capacity, and the first portion includes a first heater element having a first length and a first resistivity: and a second area including a second portion of the heater, wherein the second area has a second heat flux capacity, and the second portion includes a second heater element having a second length and a second resistivity. The first heat flux capacity can be different from the second heat flux capacity; the first length can be different from the second length; the first resistivity can be different from the second resistivity; or any combination thereof.

Item 2. The roofing product of Item 1, wherein the first area includes a first heater element having a first resistance, and the second area includes a second heater element having a second resistance that is greater than the first resistance.

Item 3. The roofing product of Item 1, wherein the first area includes a first heater element having a first width, and the second area includes a second heater element having a second width that is less than the first width.

Item 4. The roofing product of Item 1, wherein the first resistivity is less than the second resistivity, the first heater element has a first width, and the second heater element has a second width is within approximately 9% of the first width.

Item 5. The roofing product of Item 1, wherein the roofing product includes a roofing underlayment or a shingle.

Item 6. The roofing product of Item 1, wherein the roofing product has a first edge that is configured to be installed closer to an eave of a roof and a second edge opposite the first edge, wherein the first edge is closer to the first heater element than the second heater element.

Item 7. The roofing product of Item 1, wherein the roofing product is configured to be installed on a roof adjacent to an intersection of a first roof portion and a second roof portion to define an intersection centerline; and the intersection centerline is closer to the first heater element than the second heater element.

Item 8. The roofing product of Item 1, wherein the heater comprises a resistive ink.

Item 9. The roofing product of Item 1, wherein the heater includes heater elements that are electrically connected in parallel.

Item 10. The roofing product of Item 1, wherein the heater includes a heater element having a serpentine pattern.

Item 11. A roofing product can include a substrate and a heater disposed along a principal surface of or within the substrate. The roofing product can include an overhang section that includes at least a portion of the heater, wherein the overhang section is capable of being folded over an edge of a roof and coupled to an object beyond the edge of the roof.

Item 12. The roofing product of Item 11, wherein the overhang section is configured to be attached to a gutter or a downspout.

Item 13. The roofing product of Item 11, wherein the heater includes another portion outside of the overhang section, wherein the portion of the heater within the overhang section has a first heat flux capacity, and the other portion of the heater has a second heat flux capacity that is less than the first heat flux capacity.

Item 14. The roofing product of Item 13, wherein the other portion of the heater is configured to be installed over a roof deck.

Item 15. The roofing product of Item 11, wherein the heater comprises a resistive ink.

Item 16. The roofing product of Item 11, wherein the heater includes heater elements that are electrically connected in parallel.

Item 17. The roofing product of Item 11, wherein the heater includes a heater element having a serpentine pattern.

Item 18. A method of installing a roofing product can include providing a roofing product comprising a substrate and a heater disposed along a principal surface of or within the substrate. The heater can includes a first area including a first portion of the heater, wherein the first area has a first heat flux capacity, and the first portion includes a first heater element having a first length and a first resistivity: and a second area including a second portion of the heater, wherein the second area has a second heat flux capacity, and the second portion includes a second heater element having a second length and a second resistivity. The first heat flux capacity can be different from the second heat flux capacity; the first length can be different from the second length; the first resistivity can be different from the second resistivity; or any combination thereof. The method can further include orienting the roofing product along a roof such that a predetermined region of the roof is closer to the first area as compared to the second area; and installing the roofing product such that the first area of the heater overlies the predetermined region of the roof.

Item 19. The method of Item 18, wherein the roof includes another region, an eave of the roof is closer to the predetermined region than the other region; and installing the roofing product is performed such that the second area of the heater overlies the other region of the roof.

Item 20. The method of Item 18, wherein an intersection of a first roof portion and a second roof portion defines an intersection centerline; the roof includes another region, the intersection centerline is closer to the predetermined region than the other region; and installing the roofing product is performed such that the second area of the heater overlies the other region of the roof.

Item 21. The method of Item 18, wherein a metal-containing object extends though or is attached over a roof, wherein at least a portion of the metal-containing object is exposed and overlies a plane defined by the roof; the roof includes another region, the metal-containing is closer to the predetermined region than the other region; and installing the roofing product is performed such that the second area of the heater overlies the other region of the roof.

Item 22. A method of installing a roofing product can include providing a roofing product comprising a substrate and a heater disposed along a principal surface of or within the substrate, wherein roofing product has a section that includes at least a portion of the heater; installing the roofing product over a roofing deck; and coupling the section to an object that extends beyond an edge of the roof or over a plane defined by a roof.

Item 23. The method of Item 22, wherein coupling the section comprises attaching the section to a wall of a gutter.

Item 24. The method of Item 22, wherein coupling the section comprises attaching the section to a downspout.

Item 25. The method of Item 22, wherein coupling the section comprises attaching the section to a metal-containing object that extends though or is attached over a roof, wherein at least a portion of the metal-containing object is exposed and overlies the plane defined by the roof.

Item 26. A method of forming a roofing product can include providing a substrate and forming a heater along a principal surface of or within the substrate. The heater can include a first area including a first portion of the heater, wherein the first area has a first heat flux capacity, and the first portion includes a first heater element having a first length and a first resistivity: and a second area including a second portion of the heater, wherein the second area has a second heat flux capacity, and the second portion includes a second heater element having a second length and a second resistivity. The first heat flux capacity can be different from the second heat flux capacity; the first length can be different from the second length; the first resistivity can be different from the second resistivity; or any combination thereof.

Item 27. The method of Item 26, wherein forming the heater is performed using a stencil printing technique.

Item 28. The method of Item 27, wherein forming the heater comprises screen printing heater elements.

Item 29. The method of Item 28, wherein screen printing is performed using a rotary object that includes features corresponding to the heater elements; at least two of the heater elements have different dimensions; and the heater elements are formed in a repetitious pattern over the substrate using a continuous process.

Item 30. The method of Item 29, further comprising separating the substrate into a first substrate piece and a second substrate piece after forming the heater, wherein the each of the first and second substrate pieces includes at least one of the heater elements.

Item 31. The method of Item 27, wherein forming the heater comprises placing a stencil mask adjacent to the substrate, wherein at least one of the openings in the stencil mask corresponds to locations where the heater elements are to be formed; and depositing a layer over the stencil mask and the substrate, wherein the heater element is formed on the substrate and has a shape that corresponds to the opening in the stencil mask.

Item 32. The method of Item 26, wherein forming the heater comprises printing the heater element using a printing tool that includes a printing head that rasters over a portion of the substrate.

Item 33. The method of Item 26, wherein forming the heater comprising printing a plurality of resistive inks having different resistivities.

Item 34. The method of Item 26, wherein forming the heater comprises depositing a layer over the substrate; and patterning the layer to define the heater elements.

Item 35. The method of Item 26, further comprising forming a layer over the substrate and heater elements.

Item 36. The method of Item 35, wherein the layer comprises a polymer.

Item 37. The method of Item 35, wherein the layer comprises a bituminous material.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. A roofing product for a roof, the roofing product comprising:

a substrate; and a heater disposed along a principal surface of or within the substrate, the heater comprising:

a first heater element having a first heat flux capacity;

a second heater element connected in parallel to the first heater element and having a second heat flux capacity that is less than the first heat flux capacity; and a third heater element connected in parallel to each of the first heater element and the second heater element and having a third heat flux capacity that is less than the second heat flux capacity;

wherein a length of the first heater element, the second heater element, and the third heater element are equal;

wherein the first heater element, the second heater element, and the third heater element comprise a uniform thickness as measured from the substrate;

wherein the first heater element comprises a uniform width along the length of the first heater element, wherein the second heater element comprises a uniform width along the length of the second heater element, and wherein the third heater element comprises a uniform width along the length of the third heater element; and wherein the roofing product is configured to be installed on the roof with the first heater element closer to an eave of the roof than is the second heater element and the second heater element closer to the eave of the roof than is the third heater element.

2. The roofing product of claim 1, wherein the roofing product further comprises a roofing shingle having bituminous material and roofing granules disposed over the substrate of the roofing product.

3. The roofing product of claim 1, wherein the first heater element comprises a greater width than the second heater element, and wherein the second heater element comprises a greater width than the third heater element.

4. The roofing product of claim 1, wherein the first heater element comprises a different shape than the second heater element.

5. The roofing product of claim 1, wherein the roofing product comprises:

a roofing shingle having bituminous material and roofing granules disposed over the substrate of the roofing product; or an underlayment configured to be located beneath a substrate of a roofing shingle having bituminous material and roofing granules.

6. The roofing product of claim 1, further comprising: at least one nail zone established between the first heater element and the second heater element, and at least one nail zone between the second heater element and the third heater element, wherein the nail zones are configured to receive a nail therethrough to attach the roofing product to the roof.

7. The roofing product of claim 1, further comprising: a fourth heater element having a fourth heat flux capacity that is less than the first heat flux capacity, wherein the roofing product is configured to be installed on the roof with the first heater element, the second heater element, and the third heater element closer to a valley of the roof than is the fourth heater element.

8. The roofing product of claim 7, wherein a length of the fourth heater element is equal to the length of the first heater element, the second heater element, and the third heater element.

9. The roofing product of claim 7, wherein the roofing product is configured to be installed on the roof with the fourth heater element closer to an eave of the roof than is the second heater element.

* * * * *